US009290905B1

(12) United States Patent
Diaz et al.

(10) Patent No.: US 9,290,905 B1
(45) Date of Patent: Mar. 22, 2016

(54) REMOTE EXCAVATION TOOL

(71) Applicants: Angel Diaz, Lorton, VA (US); Lee Foltz, Indian Head, MD (US); Bruce James Strackbein, Arnold, MD (US); David Rivera Marchand, Arlington, VA (US)

(72) Inventors: Angel Diaz, Lorton, VA (US); Lee Foltz, Indian Head, MD (US); Bruce James Strackbein, Arnold, MD (US); David Rivera Marchand, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/121,625

(22) Filed: Sep. 29, 2014

(51) Int. Cl.

| | |
|---|---|
| ***A01B 33/00*** | (2006.01) |
| ***E02F 5/30*** | (2006.01) |
| ***E02F 3/18*** | (2006.01) |
| ***E02F 9/00*** | (2006.01) |

(52) U.S. Cl.
CPC ..... *E02F 5/305* (2013.01); *E02F 3/188* (2013.01); *E02F 9/00* (2013.01); *Y10S 901/01* (2013.01); *Y10S 901/41* (2013.01)

(58) Field of Classification Search
CPC ..... A01B 15/00; A01B 15/16; A01B 51/026; A01B 33/02; G05D 1/0038; G05D 1/0094; G05D 1/0088; E02F 5/305; E02F 3/188; E02F 9/00; Y10S 901/41; Y10S 901/01
USPC ..... 172/42, 51, 103, 107, 273, 274, 351, 172/433, 810; 701/2, 24, 50
See application file for complete search history.

(56) References Cited

U.S. PATENT DOCUMENTS

| | | | |
|---|---|---|---|
| 5,507,351 | A | 4/1996 | Martin |
| 5,562,166 | A | 10/1996 | Griffin |
| 7,743,683 | B2 | 6/2010 | Dayton et al. |
| 7,895,930 | B2 | 3/2011 | Fisk et al. |
| 8,162,072 | B2 | 4/2012 | Marcil et al. |
| 2008/0086241 | A1 | 4/2008 | Phillips et al. |

OTHER PUBLICATIONS http://www.yetterco.com/products.

*Primary Examiner* — Robert Pezzuto
(74) *Attorney, Agent, or Firm* — Fredric J. Zimmerman

(57) ABSTRACT

The remote excavator tool fastens to a robotic arm on a remotely controlled robotic platform that includes a track drive. The tool uses high speed tilling elements rotating at about 1500 rpm to dig, efficiently, a trench using a small amount of power. The tilling elements are hardened steel, rotating counterclockwise to a conventional tiller. The tilling elements are symmetrically mounted on a polygonal shaft, and include right and left multiple couples of paired facing disks with staggered curved tines, where the tines are thick and have tapered hardened edges. Round brushes are inter-spaced between couples. The loosen soil is pushed forward and to the sides to help protect the robotic platform and maintain control of the tool especially as the rate of the excavation partially depends on the characteristics of the material being excavated.

18 Claims, 9 Drawing Sheets

Figure 11 (TABLE 1)

DC MOTOR PERFORMANCE PARAMETERS:

| | |
|---|---|
| Rated DC Voltage | 24.0 DC VOLTS |
| Rated Continuous Current | 10.0 AMPERES |
| No-Load Speed | 6480 RPM MAX |
| Rated Speed | 5700 RPM +/- 15% |
| Rated Continuous Power Out | 211 WATTS +/- 15% |
| Rated Continuous Torque | 50.0 OZ-IN |
| Peak Torque (motor only) | 500 OZ-IN |
| No-Load Current | 1.20 AMPERES MAX |
| Back EMF Constant (Ke) | 3.7 V/KRPM +/- 10% |
| Torque Constant (Kt) | 5.0 OZ-IN/AMP +/- 10% |
| DC Armature Resistance (@1.5 amps) | 0.46 OHMS +/- 15% |
| Armature temperature | 155 DEG. C MAX |

REMOTE EXCAVATION TOOL

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to excavation tools, as exemplified by a conventional rotor tiller; and more particularly to a remote excavation tool for robotically removing soil, where the tool has a relatively low mass that efficiently utilizes low power and high rotation to excavate, where the tool is fitted to a remotely controlled robotic platform.

2. Background

Robotic platforms nominally have a robotic arm that can be remotely controlled. The platform can include lights, transmitted video, GPS positioning, and movement of the robotic arm, which often includes a gripping device. Depending on the mission, the robotic platform can also include sensors; one or more propulsion means including continuous tracks, wheels, propellers, fixed wings, jets and rockets. Military robots can also have weapons including projectiles and may be fitted to carry items that are heavy and/or dangerous, such as unexploded ordnance.

Another example of a robotic platform is the MTRS platform (Man Transportable Robotic System). The robotic device can be used to dispense detonation chord.

Tilling implements use rotating tines to break up soil. Rotation is relatively slow, often approximately 250 rpm. The slow rotation is usually clockwise, thus enabling an operator to keep pace with the tiller, while not needing to have to pull the tiller forward. Even home garden tillers are purposely heavy so that tines generate enough force to penetrate and loosen the soil. Conventional tillers require a large power source to carry its mass.

The tine count on conventional tilling implements is relatively low so that the downward and forward force is focused. Slow rotating tines are often sharply curved so that that a greater volume of soil can be churned at a slow rate of rotation. Clockwise rotation tends to move the loosened soil backwards, and a rear plate is usually present to contain the backward movement of the tilled soil.

SUMMARY OF THE INVENTION

The invention is a tool for remotely excavating soil, where the tool has a low mass and utilizes a low amount of power. The tool may be attached to a robotic platform. An aspect of the invention includes one or more interfacing elements, which enable the low mass high speed rotation tool to be attached to a robotic arm extending from the robotic platform or gripped by a robotic claw on the robotic arm or elsewhere on the robotic platform. The excavation tool, may be remotely controlled through existing electronics on the robotic platform.

The tool includes an extension boom and a drive train assembly, where the drive train assembly transmits rotational power from a rotor shaft of a motor to a polygonal shaft. The polygonal shaft rotates tilling elements mounted on the polygonal shaft. The motor has a forward fastening element and it is mounted to the extension boom. Power from the motor is conveyed through the drive train assembly to achieve the desired torque and rpm. The drive train assembly includes a drive shaft and a system of belts and pulleys or a variable mechanical interface or an electrical controller, or a combination thereof. The motor has a rearward mount for attaching the tool to an interface element, where the interface element enables the tool to be connected directly or indirectly to the robotic platform. The motor is nominally powered by a remotely controlled robotic platform.

Another aspect of the invention is that the tilling elements include a plurality of tined disks, where each tined disk has a plurality of tines. Each tine has a leading edge and a peripheral edge that are hardened and tapered. A plurality of tines radiate from a plate with a center opening, therein forming the tined disk. A pair of tined disks, where the tines curve toward a common vertical plane, define a couple, where the couple are two fastened disks. The couple functions as a toothed blade.

The tined disks are rotated by the polygonal shaft. Viewed from the right side, the polygonal shaft rotates counterclockwise. Tines on the tined disks rotate so they tend to dig deeper, pushing into the soil; which is in contrast to a conventional tilling implement, where the tines are rotated clockwise so as to pull the tilling implement forward. When rotated counterclockwise, the tapered edges of the tines on the disks are leading.

Left and right lengths of the polygonal shaft are fitted with multiple couples of tined disks, and between them are rotating round brushes that are mounted on the polygonal shaft. The rotating round brushes push loosened soil forwards and sideways, and a diameter of a brush limits the depth of penetration of the tines. Excavation is more uniform, and less likely to overly strain either the right or the left length of the polygonal shaft. Generally, with the invention, soil is pushed forward, away from the excavation tool and the robotic platform.

The apparatus utilizes high speed rpm rotation, on the order of about 1500 rpm+/−100 rpm, in contrast to conventional excavation equipment, which uses comparatively low speed rotation to excavate soil. Recall, that conventional excavation equipment rotates at about 250 rpm.

Both the desired cutting depth and feed rate may be adjusted robotically depending on the amount of soil removed and the cutting resistance.

The apparatus utilizes a "high cycle, low force" methodology. The low mass of the invented robotic apparatus enables control of an effective cutting depth. In contrast to a conventional a rotor tiller (such as on a garden tiller), where substantially the entire actual weight of the excavating tool is used to push down on the soil—making control of the cutting depth extremely difficult. In further contrast to conventional technology, the amount of force that the inventive tool applies against the ground is largely controlled by its angle relative to the ground and the speed of the robotic platform. Of course the angle that the tool is extending from the robot and the speed of the robot are remotely controllable.

An object of the invention is to mitigate vibration and maintain reaction-force symmetry. This objective is achieved based on the following exemplary structure. Assuming each side of the polygonal shaft is fitted with a set of four paired tined disks, where the tines are uniformly staggered and positioned, then the tines are offset about the same number of degrees on both sides of the tool. Also, the symmetry provides that only one left tine and one right tine will hit the ground, if the ground is substantially level. Staggering the tines increases the frequency of impact, and the symmetry nominally transmits a smoother force response. The center holes maintain an exact angle on the polygonal shaft The transmitted cutting force onto the ground with simultaneous contact of two tines with the ground, means less tine area, and therefore a more focused pressure is applied, therein fracturing soil more effectively. The concentration of the force is augmented by the counter-rotation, which causes the remote excavator tool to dig down, once the surface is breached. A balance of depth, forward speed, angle and rate of rotation influence the feed rate of soil.

BRIEF DESCRIPTION OF THE DRAWINGS

The foregoing invention will become readily apparent by referring to the following detailed description and the appended drawings in which:

FIG. 11 (TABLE 1), which contains the performance data for the motor.

DETAILED DESCRIPTION OF THE INVENTION

Figure 1:
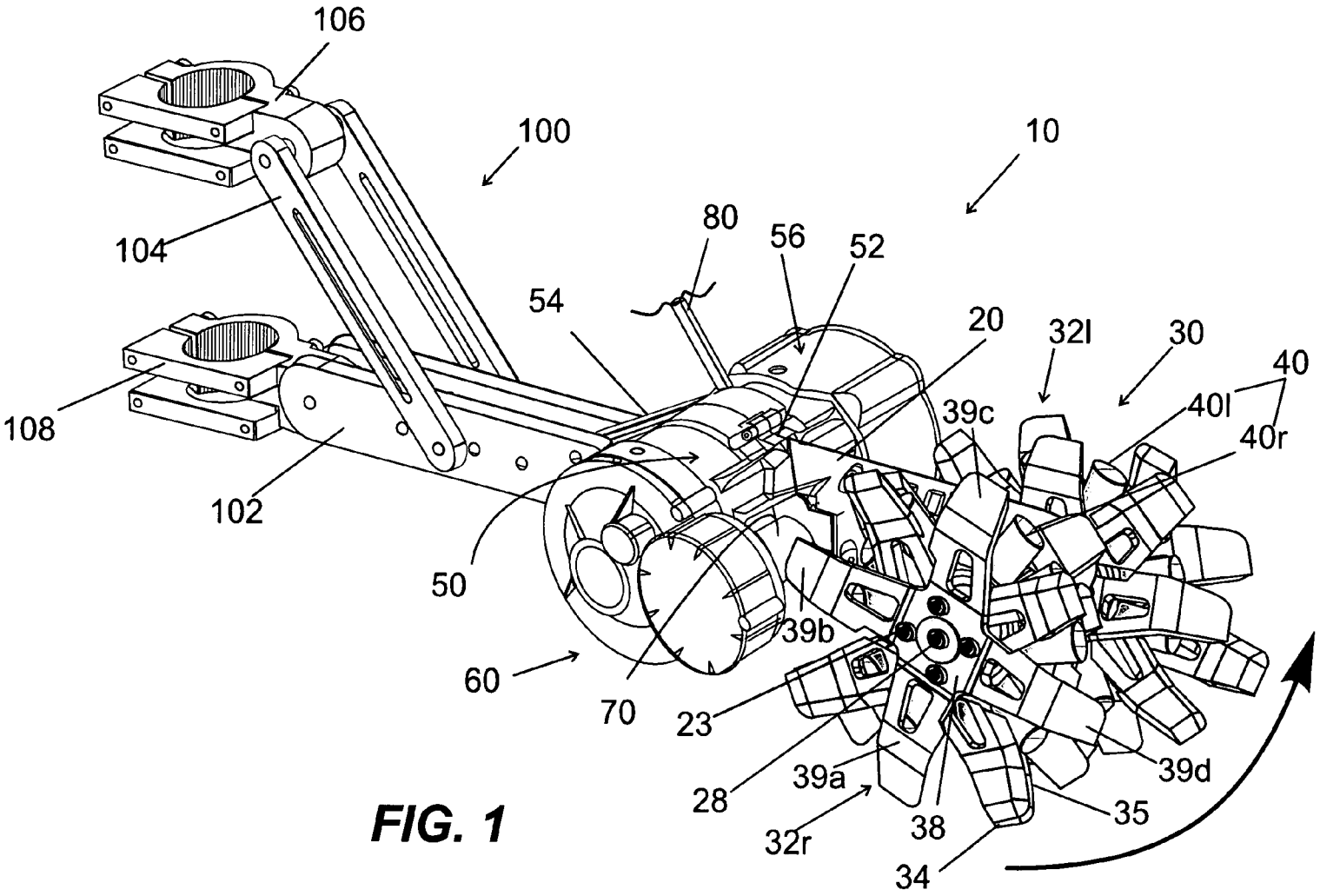
FIG. 1 is an elevated perspective right-side view of an exemplary embodiment of the invented remote excavation tool, wherein the tool is has an interface element that is fastened to the tool's rearward mount and can be clamped to a robotic arm on a robotic platform.
Figure 9:
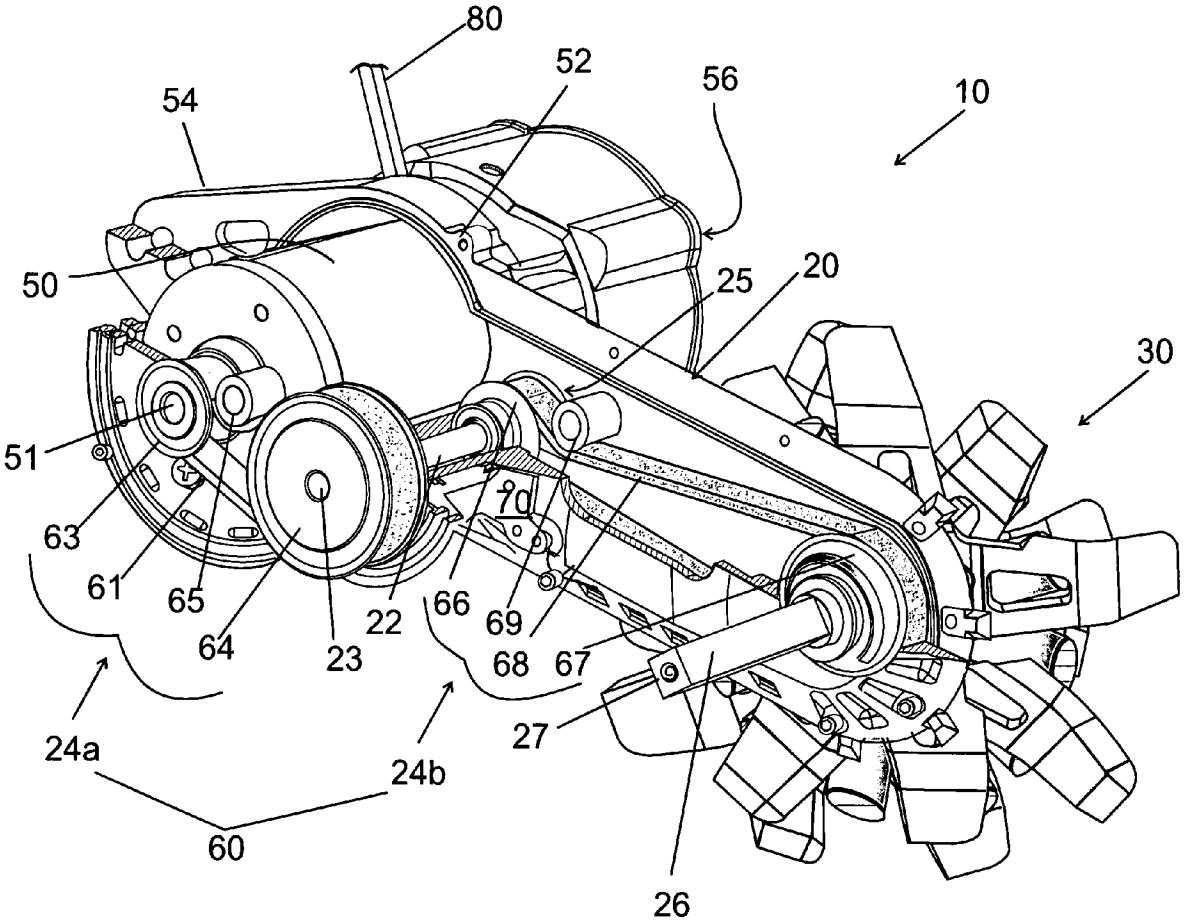
FIG. 9 is an elevated perspective partial view of the invention illustrating a drive train assembly having a first and second belt-and-pulley drive trains, where in both drive trains a driven smaller pulley drives grooved belt which turns a larger pulley, wherein the first and second belt-and-pulley drive trains have a common driveshaft seated in the bearing housing, where an out-board end of the driveshaft has a larger diameter pulley than the inboard pulley in the extension boom, wherein the assembly terminates in a slower turning polygonal shaft projecting from the extension boom.

The invention is a remote excavation tool that enables soil to be excavated using a low power, low mass tool. An exemplary embodiment is illustrated in the following drawings. In FIG. 1 and FIG. 9, the tool 10 includes a drive train assembly and an extension boom 20 where the extension boom has a bearing housing 70, which supports a driveshaft 22 (see FIG. 9). The driveshaft is common to a first and a second belt-and-pulley drive train 24*a*,24*b* as shown in FIG. 9. The belt-and-pulley drive trains 24*a*,24*b* work in combination to increase in torque and decrease in rpm of a polygonal shaft 26. The polygonal shaft 26 turns the tilling elements 30. The first drive train derives power from a rotor shaft 51 of a motor 50. The first belt-and-pulley drive train 24*a* has a first smaller pitch diameter grooved pulley 63, a first larger pitch diameter grooved pulley 64 on an out-board end 23 of the driveshaft 22, and a first grooved belt 61 that is tensioned with a first idler roll 65. The first belt 61 transmits rotational power from the rotor shaft 51 of the motor 50 to the driveshaft 22.

The second belt-and-pulley drive train 24*b* is located within the extension boom 20, and the drive train 24*b* has a second smaller pitch diameter grooved pulley 66 on an inboard end 25 of the driveshaft 22, a second larger pitch diameter grooved pulley 67 on the polygonal shaft 26, and a second belt 68 that is tensioned with a second idler roll 69. The second belt 68 transmits rotational power from the second smaller diameter pulley 66 to the second larger diameter pulley 67 which drives the polygonal shaft 26. Taken together, the two drive trains increase torque and decrease the rpm. A nominal rpm range from about 1400 to about 1600 rpm is obtained using the motor described later.

The illustrated polygonal shaft 26 is a square bar, and it rotates the tilling elements 30 mounted on the square bar. The motor in the illustrated exemplary embodiment includes a housing 51. The extension boom 20 is substantially contiguous with the motor housing which provides a forward fastening element 52 whereby the motor is mounted to the extension boom 20. In an example of the drive train assembly utilizing grooved belts (timing belts), the first belt-and-pulley drive train has a first smaller pulley with a pitch diameter of about 0.637 inches and 10 grooves, and a first larger pulley with a pitch diameter of about 1.4010 inches and 22 grooves, where the rpm is reduced by a factor of about 22/10, or 2.2. The second belt-and-pulley drive train has a second smaller pulley with a pitch diameter of about 0.637 inches and 10 grooves, and a second larger pulley with a pitch diameter of about 1.146 inches and 18 grooves, the rpm is reduced by a factor of about 18/10, or 1.8. Cumulatively, the combined reduction is 1.8*2.2=3.96.

The drive train assembly 60 may utilize other means, including a gear box, a variable mechanical interface (i.e., intersecting cones), an electrical controller, or a combination thereof. In the illustrated embodiment, a suitable motor is, in an exemplary embodiment, a product of MIDWEST MOTION PRODUCTS®, and the performance parameters are given in Table 1. The rated speed of the DC motor is about 5700 rpm. The desired rpm for the polygonal shaft is about 1500+/−100 rpm. Based on the calculated reducing of 3.96, then the rpm is about 1439 (5700/3.96=1439 rpm). The illustrated motor 50 has a fan 56 to cool the motor and to maintain a positive air pressure on the extension boom 20. The motor and the fan also may be used as a dynamic braking device, by altering the electrical power coming from the robotic platform.

Figure 2:
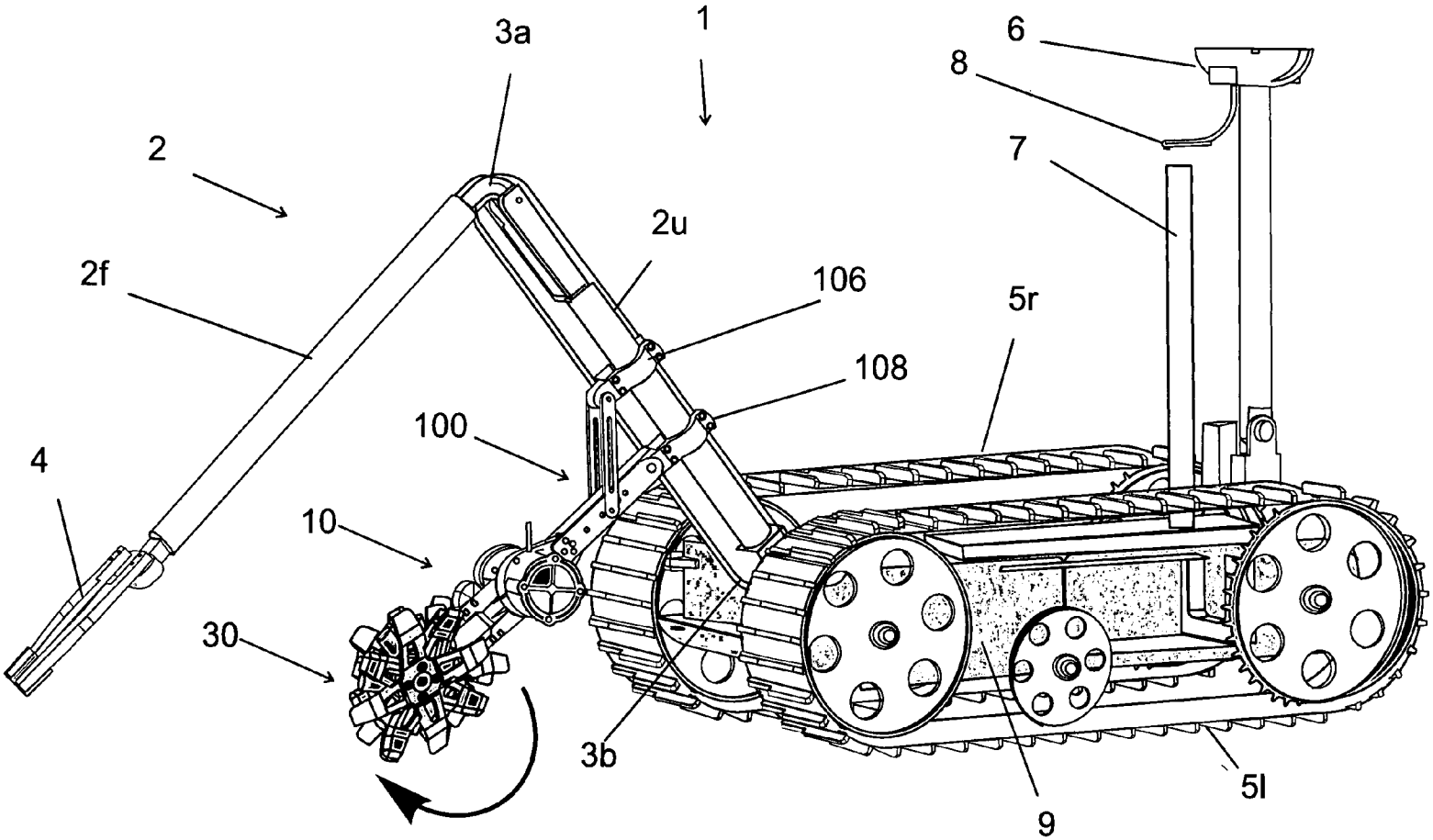
FIG. 2 is a side perspective left-side view of the embodiment shown in FIG. 1, wherein the interface element is clamped around a lower portion of the robotic arm.
Figure 3:
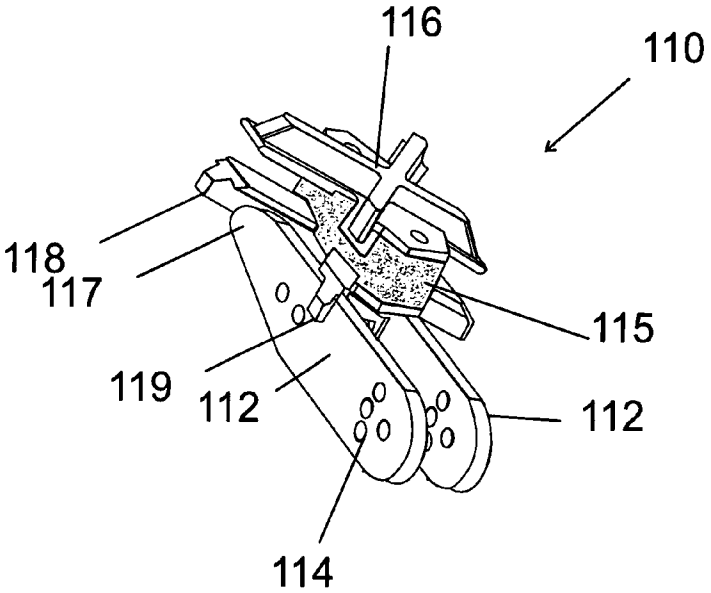
FIG. 3 is a perspective view of another interface element illustrating a claw mounting device, wherein the claw mounting device can be attached to the rearward mount, which the claw on the robotic arm can then grasp to hold the remote excavation tool.

The motor 50 has a rearward mount 54 for attaching the tool to an interface element 100, or a variation of the interface element 110 as depicted in FIG. 3 The interface element enables the tool to be connected directly or indirectly to a robotic platform, such as a Man Transportable Robotic System (MTRS) (see FIG. 2). The motor, and hence the rotation of the tines, may be controlled remotely. Wires 80, shown diagrammatically, enable the tool 10 to tap into the power (such as, BB2590 batteries) and communication capabilities of the robotic platform to which the tool is attached. Existing robotic platforms, for example a MTRS, have auxiliary connections, and control of the invented tool is enabled by activating an auxiliary switch (not shown). In an exemplary embodiment, the BB2590 batteries have about 207 Wh, a rugged case construction, a high energy density (144 Wh/kg), a wide operating temperature range, and are relatively light weight.

Communication with the robotic platform 1 enables remote control of the tool 10. Capabilities include starting, stopping, and dynamic braking the tilling elements 30 on the tool 10. Remote auxiliary control maybe largely independent of other robotic platform activities or in concert with them. For example, video feedback from the platform's camera 6, provides an operator with a way to observe the excavation, and based on the video the operator can remotely adjust how the tool is being used.

The interface element 100 includes an adjustable extension assembly 102 with a pivotal lower collar 108, and a pivoting strut assembly 104 with a pivotal upper collar 106. The extension assembly 102 attaches to the rearward mount 54. The collars 108,106 may be disassembled to be positioned, and tightened around the robot arm to secure the attachment. As shown in FIG. 2 the robotic platform 1 has a jointed arm 2 with a forearm 2*f*, an elbow joint 3*a*, an arm joint 3*b*, an upper-arm 2*u*, and a claw 4. The illustrated robotic platform has right and left track drives 5*r*,5*l*. The robot is remotely controlled through a communication antenna 7. A camera 6 provides video feedback. Electronics and energy sources (i.e., batteries) are protected by a body 9. Auxiliary power and detonation chord may be pulled by the strain relief 7. The tilling elements 30 rotate pushing excavated soil forward and to the side. The depth and angle that the excavation tool impinges the ground may be adjusted by changing the angle of the arm 2, and in particular the upper-arm 2*u* at the arm joint 3*b*.

Figure 4:
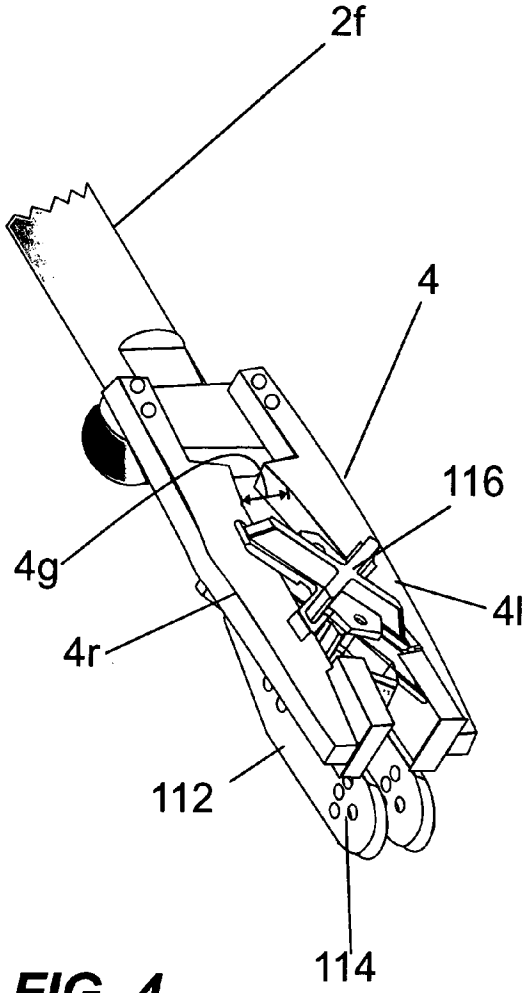
FIG. 4 is a perspective partial view of an illustrated robotic arm having a claw, wherein the claw is gripping the claw mounting device illustrated in FIG. 3 (the tool is not shown)

A variation of the arm interface element 100 is shown in FIG. 3 and FIG. 4. The interface element 110, which is a variation, is a claw interface element 110. The claw interface element 110 includes a pair of parallel elongate plates 112 with holes 114 for fastening to the rearward mount 54. A rear 117 and upper mid-section 119 of the plates 112 are connected to a first crossed frame 118. A spacer 115 separates and joins the first crossed frame 118 to a second crossed frame 116. The thickness of the spacer 115 is selected such that jaws 4*r*,4*l* of the claw may grip the spacer 115, leaving the first and second crossed frames 118,116 to span a gap 4*g* between the jaws of the claw.

Returning to FIG. 1, in the illustrated embodiment the tilling elements 30, which include brushes 40*l*,40*r* and tined disks 32*l*,32*r* that are rotated by the polygonal shaft 26. The tilling elements are so close together in this view that most of the polygonal shaft 26 is not visible. A better view is shown in FIG. 9. A flanged screw 28 attaches to a tapped end 27 of the polygonal shaft 26, therein securing the tined disk 32*r*. Tined disk 32*r* is coupled to an adjoined facing tined disk with screws 23.

The tilling elements 30 on one side of the tool include a round brush 40 positioned between two coupled tined disks.

Figures 5A, 5B:
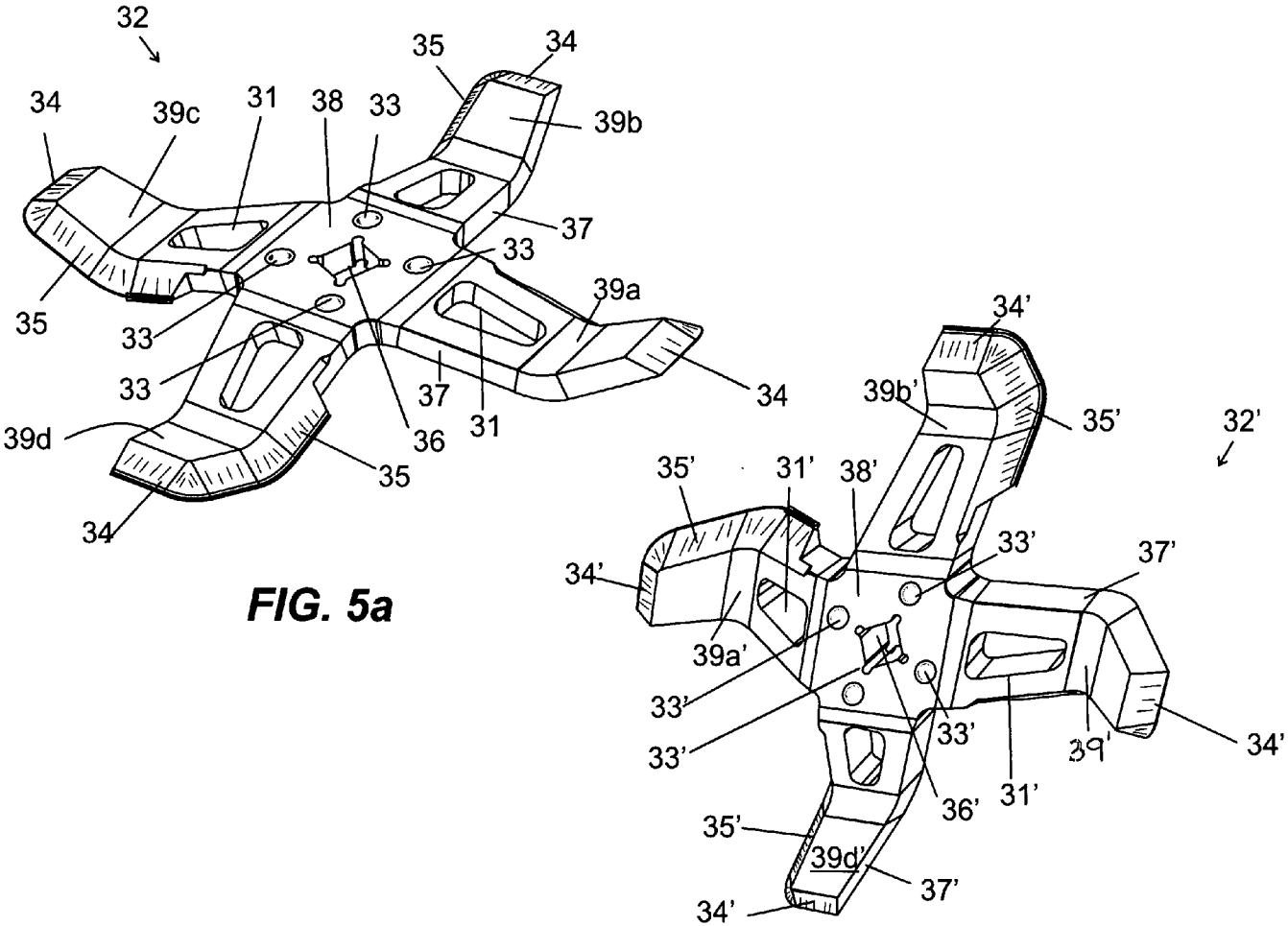
FIG. 5*a* is a perspective view of a first tined disk having tapered leading edges and wherein the four tines curve inward.
FIG. 5*b* is a perspective view of a second tined second disk, wherein the tines are a mirror image of the first tined disk, so that when coupled with a first tined disk the tines curve toward the first disk and the tapered edges are similarly on the leading edges.

A separated couple of tined disks 32,32' is illustrated in FIGS. 5*a* and 5*b*. The tines illustrated in 5*b* are the mirror image of the tines in 5*a*. The tapered edges 35,35' and tapered ends 34,34' are hardened and sharpened cutting edges, and the edges provide an effective tilling surface of the soil. The non-tapered edges 37,37' provide strength. As illustrated, disk 32 has four tines 39*a*,39*b*,39*c*,39*d* and disk 32' has four tines 39*a*',39*b*',39*c*',39*d*'. The tines radiate from a plate 38,38' that has a polygonal center opening 36,36', where the polygon is a square, having dimensions that enable a snug fit on the polygonal shaft, which is also square. All of the tines on a single disk are similar in shape and each individual tine is orthogonal to an adjacent tine. The tines on a single tined disk are separated by about 90 degrees. The tines curve at a distal point 39, 39'. More medially, the tines widen and have an elongate opening 31,31' that enables shearing and lateral movement of soil during excavation. The plate 38,38' has four holes 33,33' for joining opposing disks.

Figure 10:
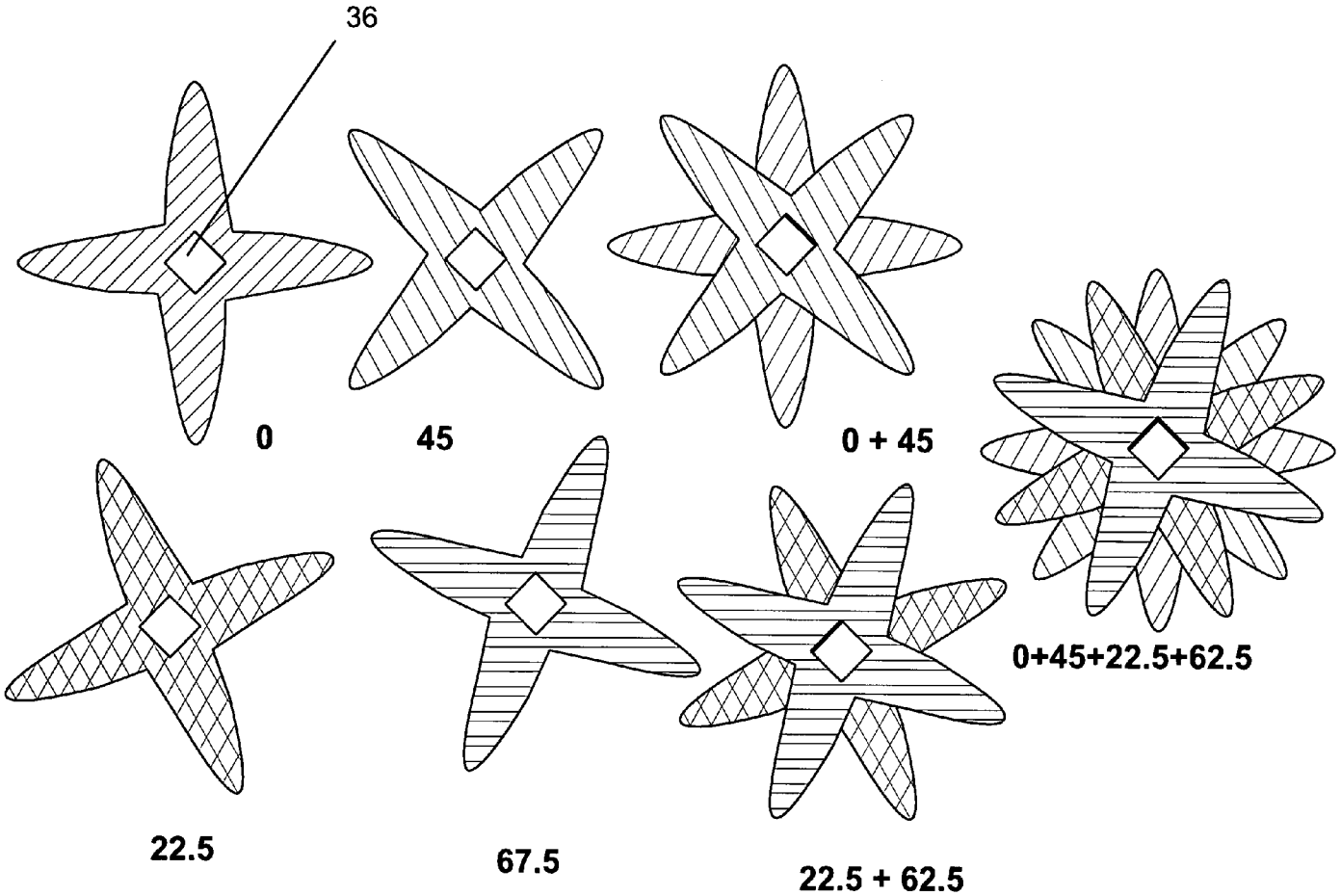
FIG. 10 is a diagrammatic view that illustrates how the tines are staggered.

The tined disks are mounted in pairs, and the angle of the mount is diagrammatically illustrated in FIG. 10. In an exemplary embodiment, assume a first square center opening 36 on a first tined disk has an angular position of 0°. A second square center opening on a second tined disk has an angular position that is angled 45° from the first disk. The disks in this figure are labelled with the degrees that they must be angled to have square center openings that are aligned. Combined first and second disks are inner disks (0°+45°). In order to align the second square center opening with the first square center opening, so that both disks can be positioned on the square bar, the tines on the second disk are rotated 45° degrees. The first and second disks have aligned square center openings, and the tines of the second disk bisect the tines on the first disk. A third square center opening in a third disk is rotated about 22.5° from the first disk, and a fourth square center opening on a fourth tined disk has an angular position that is about 45° from the third square center opening on the third disks (total of 67.5° from first disk). Combined third and fourth disks are outer couples)(22.5°+67.5°. Positioned on the square bar, the tines on the third disk and fourth disks will bisect the tines on the first and second disk. The combined effect is that the sixteen tines (0°+45°+22.5°+67.5°) on a right length of the polygonal shaft are separated by 22.5°. From inspection, the reader may see that only one tine on one side would be in orthogonal contact with the soil, assuming the ground is a horizontal plane. In the invention, both the right and left lengths of the shaft are loaded with sets of staggered disks, where the left and right inner disks are an inner couple having an angular position of 0° combined with a 45° disk. In the case of the outer fourth disk, it has an angular position that is 45° (66.7° from the first disk) from the third square center opening on the third disk, where the third square center opening in the third disk has already been rotated 22.5° from the first disk. The tines on the left side are positioned and aligned with the tines on the right side.

Figure 7A:
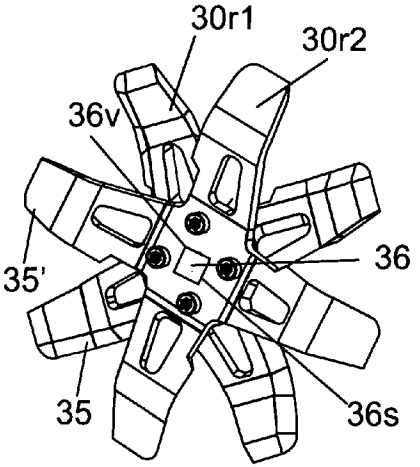
FIG. 7*a*-7*c* is a plan view as seen from the right side of the tool, wherein the coupled disks are shown in FIG. 7*a* and FIG. 7*c*, and the brush on the right is shown in FIG. 7*b;*

FIGS. 7*a*,7*b*,7*c* and FIGS. 8*a*,8*b*,8*c* illustrate the confluence of the relative angle between disks as previously illustrated in FIG. 10, the brushes and the influence of the shape on the symmetry of the tined disks. In FIG. 7*a*, as seen looking down the polygonal shaft from the right side, right inner couple includes disks 30*r*1 and 30*r*2. The vertices 36*v* of the open center square 36 are substantially aligned with the rear most tines of the first disk 30*r*1. Rotation is counterclockwise so the leading edge 35 of the tines on the first disk is on the counterclockwise edges. The tines on the first disk are curved toward the viewer. The second disk is paired with the first disk 30*r*2, and it faces the first disk 30*r*1. The leading edges 35' of the tines on the second disk 30*r*2 are also on the counterclockwise edges wherein the tines of the second disk are a mirror image of the tines on the first disk. The square center opening 36 on the second disk is rotated 45° from the first disk, so the tines on the second disk are aligned with the sides 36*s*, instead of the vertices 36*v*. In short, portions of the second disk are a mirror image; and the relative angle of the open center square has changed.

Figure 7B:
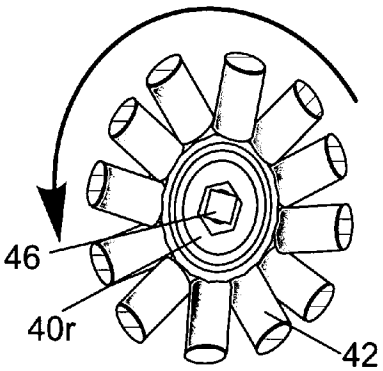

The round brush 40*r* is shown in FIG. 7*b*. The brush 40*r* has a square center axial opening 46 to affix the brush to the polygonal shaft. However, the symmetry of the round brush and the particular angularity is not relevant. The illustrated round wire brush has a plurality of radial stiff wire bundles 42. As indicated in the figure the brush rotates in the same direction as the tined disks.

Figure 7C:
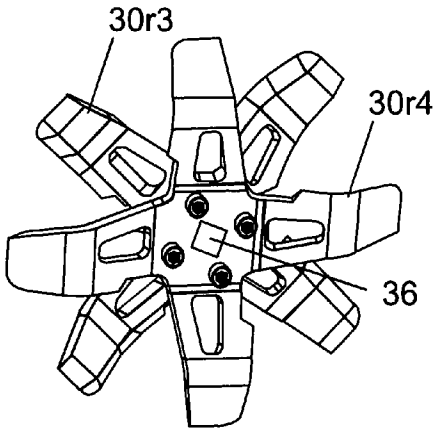

Disks 30*r*3 and 30*r*4 are illustrated in FIG. 7*c*. These disks are a right outer couple. The angle of the open center square 36 is the same as shown in FIGS. 7*a* and 7*b*. The square center opening 36 is now angled 22.5° from the position of the first disk 30*r*1. When the third disk is loaded on the square polygonal shaft, the disk has to be turned back 22.5° to slide the third disk on the polygonal shaft. The net effect is that the tines on the third disk 30*r*3 are now 22.5° counter-clockwise to the tines on the first disk 30*r*1. The fourth disk 30*r*4 faces the third disk 30*r*3, and the tines are the same as the second disk 30*r*2, that is a mirror image to the third disk 30*r*3. In the fourth disk 30*r*4 the square center opening 36 is now angled 67.5° from the position of the first disk 30*r*1, which is 45° more than the third disk. The fourth disk 30*r*4 is turned back 67.5° to slide the fourth disk on the polygonal shaft. The angle of the square center opening 36 is constant over FIGS. 7*a*, 7*b* and 7*c*, but the relative position of the tines has changed. Taken together, the four tines on the first disk are bisected by the four tines on the second disk, so that each tine is 45° apart. The third and fourth disks bisect the angle of separation down to 22.5°.

Figure 8A:
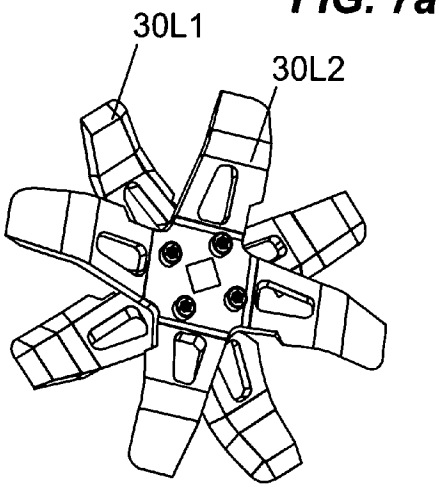
FIG. 8*a*-8*c* is a plan view as seen from the left side of the tool, wherein the coupled disks are shown in FIG. 8*a* and FIG. 8*c*, and the brush on the left side is shown in FIG. 8*b;*
Figure 8B:
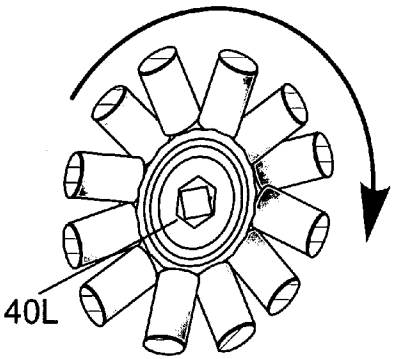
Figure 8C:
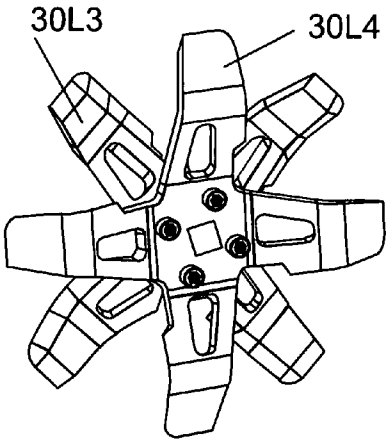

FIGS. 8*a*,8*b* and 8*c* are the same as FIGS. 7*a*,7*b* and 7*c*, except that it is a view of disk elements on the left side of the tool. Disks 30L1 and 30L2 are the left inner couple disks 30L3 and 30L4 are the left outer couple. There is a tine on the left side that has the same angle and position as a tine on the right side. This assembly mitigates vibration and has reaction-force symmetry.

The invented tines in the illustrated embodiment are hardened, fabricated out of, in an exemplary embodiment, D2 Tool Steel, heat treated to a hardness of 60-63 on the Rockwell C scale. The hardness of this steel provides a balance of toughness and hardness. Heat treatment imparts hardness at the surface of the tines to mitigate deformation and wear. The tine thickness-to-length ratio is about 0.1:1 (for example 3/16 in thick to 2 in length). Conventional tiller tines have a thickness-to-length ratio of about 0.03:1. The invented thicker tines have increased stiffness, therein maintaining an effective geometry though an excavation cut.

Figure 6:
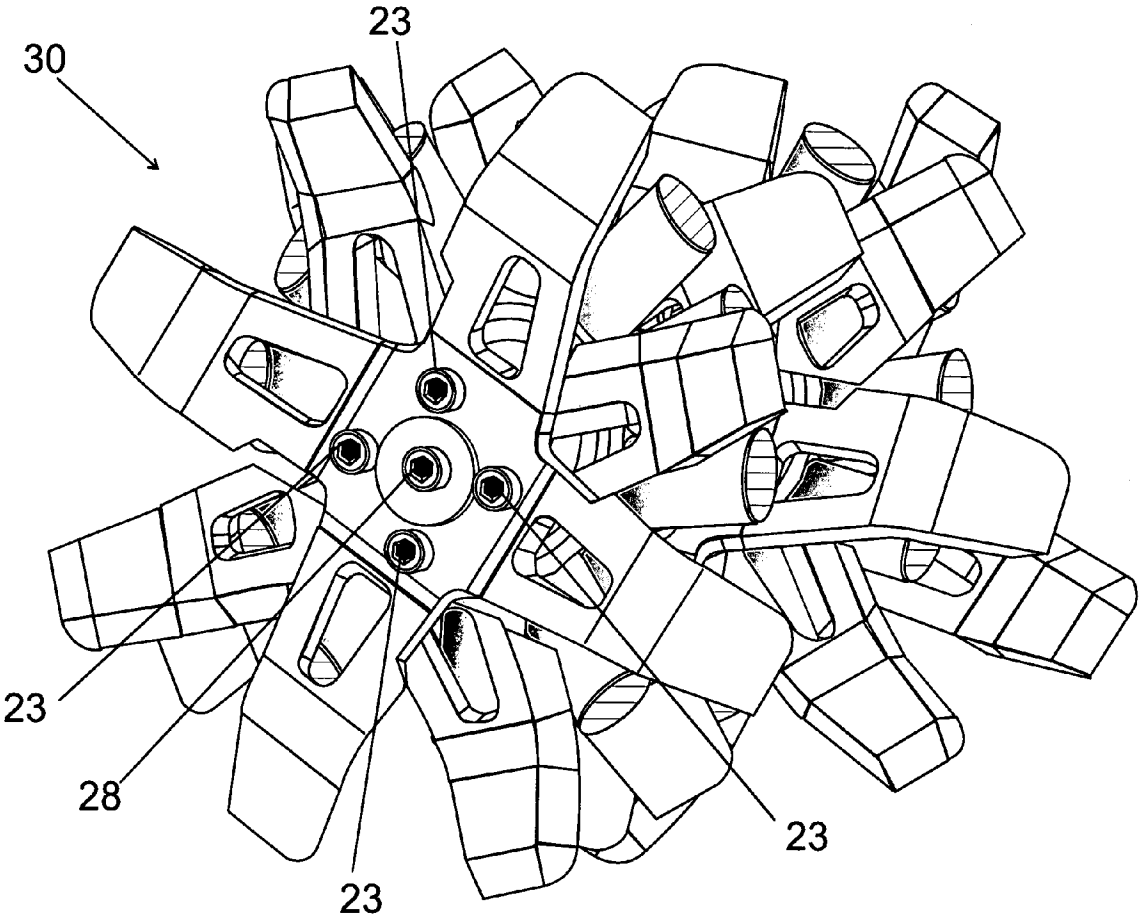
FIG. 6 is a perspective side view as seen from the right side of a full set of tined disks and brushes, wherein the full set of tined disks and brushes are loaded on the polygonal shaft of the embodiment shown in FIG. 1.

FIG. 6 illustrates all the tine elements illustrated in FIGS. 7*a-c* and FIGS. 8*a-c*. The pairs of tined disks are joined with screws 23 and tightened onto the polygonal shaft with an axial screw 28.

The rotating round brushes function to push the loosened soil forwards and sideways, and they limit the depth of penetration of the tined disks. Excavation is uniform, and less likely to asymmetrically deform the tines or the polygonal shaft. Generally, with the invention, soil is pushed forward and to the side of the excavation tool and the robotic platform.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A remote excavator tool, comprising:

an extension boom being mounted to a motor, wherein said extension boom houses a driveshaft and a belt-and-pulley drive train;

a polygonal shaft being attached to the belt-and-pulley drive train, wherein said polygonal shaft includes a right length and a left length that are comparable, and wherein each said right length and said left length extend outward from the extension boom;

a set of tilling elements being symmetrically mounted on the right length and the left length of the polygonal shaft, wherein said set of tilling elements is comprised of a plurality of paired staggered tine disks and round brushes, wherein each of the paired staggered tine disks includes a first disk with an outward facing plurality of tines radiating from a first plate with a first center polygonal opening, wherein the tines are relatively thick and have a thickness-to-length ratio of about 0.1:1, a curve out-board, a leading edge, and a peripheral edge that are hardened and tapered, wherein each of the paired staggered tine disks includes a second disk with an inward facing plurality of tines radiated from a second plate with an angularly turned second center polygonal opening aligned with the first center polygonal opening, and wherein the inward facing plurality of tines are relatively thick and have a thickness-to-length ratio of about 0.1:1, a curve inward, an opposing leading edge, and an opposing peripheral edge that is hardened and tapered;

a drive train assembly, wherein the drive train assembly is comprised of mechanical elements that set an operational rotational speed of the polygonal shaft in a range from about 1400 rpm to about 1600; and a rearward mount for attaching the tool with an interface element, wherein the interface element provides a connecting assembly for the tool to be fastened to one of a robotic platform and an auxiliary element associated with the robotic platform.

2. The remote excavator tool according to claim 1, wherein the plurality of paired staggered tine disks mounted on the polygonal shaft comprise a left inner couple of paired staggered tine disks and a right inner couple of paired staggered tine disks, wherein the left inner couple and the right inner couple includes two disks, wherein the two disks include four tines, wherein the tines on the second disk are angularly offset by 45 degrees and bisect the tines on the first disk, wherein the plurality of paired staggered tine disks is further comprised of a left outer couple of paired staggered tine disks and a right outer couple of paired staggered tine disks, wherein the left outer couple and the right outer couple includes two disks, wherein each disk includes four tines, wherein the tines on a third disk are angularly offset by 22.5 degree from the first disk, wherein the fourth disk is angularly offset by 45 degrees from the third disk so that tines on the fourth disk bisect the tines on the third disk, wherein the tines on the outer couple bisect the tines on the inner couple, and wherein the symmetry provides on a flat surface only one right tine and one left tine simultaneously contact the flat surface.

3. The remote excavator tool according to claim 1, further comprising a wire making an electrical connection to the robotic platform.

4. The remote excavator tool according to claim 1, wherein the tines are comprised of D2 Tool Steel heat treated to a hardness of 60-63 on a Rockwell C scale to balance toughness and hardness, which mitigate deformation and wear.

5. The remote excavator tool according to claim 1, wherein the motor is a 24 volt DC motor with a rated power output of about 211+/−15% watts at about 5700+/−15% rpm.

6. The remote excavator tool according to claim 1, wherein a shape of the polygonal shaft is a square shaped bar.

7. The remote excavator tool according to claim 1, wherein a shape of the center polygonal opening is a center open square shape.

8. The remote excavator tool according to claim 1, wherein the interface element is comprised of an adjustable extension assembly with a pivotal lower collar and a pivoting strut assembly with a pivotal upper collar, wherein the pivotal upper collar and the pivotal lower collar are disassembled to be positioned, and wherein when positioned are configured to be reassembled and tightened around a robotic arm on the robotic platform.

9. The remote excavator tool according to claim 1, wherein the interface element is held by a claw on a robotic arm, wherein said interface element is comprised of a pair of parallel elongate plates with holes for fastening to a rearward mount, a first crossed frame, a spacer that separates and joins the first crossed frame and upper second crossed frame, and wherein a thickness of the spacer is selected from jaws, which grip the spacer to leave the first crossed frame and the upper second crossed frame in order to span a gap between the jaws of the claw.

10. The remote excavator tool according to claim 2, wherein a right round brush is positioned between the right inner couple and the right outer couple, and wherein a left round brush is positioned between the left inner couple and the left outer couple.

11. The remote excavator tool according to claim 1, wherein the set of tilling elements, which include the brushes, push loosened soil forward and to the side of the tool as the set of tilling elements are rotated.

12. The remote excavator tool according to claim 1, wherein the brushes assist to establish a functional depth of penetration of the tilling elements during a given pass of an excavation, as the brushes include a limited capability to loosen soil.

13. A remote excavator tool, comprising:

an extension boom being mounted to a motor including a rotor shaft, wherein said extension boom houses a driveshaft and a belt-and-pulley drive train;

a polygonal shaft being attached to the belt-and-pulley drive train, wherein said polygonal shaft includes a right length and a left length that are comparable, and wherein each said right length and said left length extend outward from the extension boom;

a set of tilling elements being symmetrically mounted on the right length and the left length of the polygonal shaft, wherein said set of tilling elements is comprised of a plurality of paired staggered tine disks and round brushes, wherein each of the paired staggered tine disks includes a first disk with an outward facing plurality of tines radiating from a first plate with a first center polygonal opening, wherein the tines are approximately 2 inches long and about 0.2 inches thick, and include a curve out-board, a leading edge, a peripheral edge that are hardened and tapered, and a second disk with an inward facing plurality of tines radiated from a second plate with an angularly turned second center polygonal opening aligned with the first center polygonal opening, and wherein the inward facing plurality of tines are approximately 2 inches long and about 0.2 inches thick, curve inward and include an opposing leading edge and an opposing peripheral edge that is hardened and tapered;

a drive train assembly, wherein the drive train assembly reduces a speed of a rotor by a factor of four to produce an operational rotational speed of the polygonal shaft in a range between about 1400 to about 1600 rpm; and a rearward mount for attaching the excavator tool to an interface element, wherein the interface element provides a connecting assembly for the excavator tool to be fastened to one of a robotic platform and an auxiliary element associated with the robotic platform.

14. The remote excavator tool according to claim 13, wherein the interface element is comprised of an adjustable extension assembly with a pivotal lower collar, and a pivoting strut assembly with a pivotal upper collar, wherein the pivotal upper collar and the pivotal lower collar are disassembled to be positioned, and wherein upon positioning, the collars are tightened around a robotic arm on the robotic platform, and wherein the robotic platform include a jointed arm with a forearm, an elbow joint, an arm joint, an upper-arm, a claw, a right track drive and a left track drive.

15. The remote excavator tool according to claim 14, wherein the robotic platform is remotely controlled through a communication antenna, a camera, which provides video feedback, a body protects electronics and electrical power sources, and an auxiliary power pulled in through a tower with a strain relief, and wherein a depth and an angle that the excavator tool impinges on a ground is adjusted by an angle of the arm.

16. The remote excavator tool according to claim 13, wherein the interface element is held by a claw on a robotic arm, wherein the interface element is comprised of a pair of parallel elongate plates with holes for fastening to the rearward mount, a first crossed frame, a spacer that separates and joins the first crossed frame an upper second crossed frame, and wherein the thickness of the spacer is selected such that jaws grip the spacer to leave the first crossed frame and the second crossed frame to span a gap between the jaws of the claw.

17. The remote excavator tool according to claim 13, wherein the robotic platform is a Man Transportable Robotic System (MTRS) platform.

18. A remote excavator tool, comprising:

an extension boom being mounted to a motor having a rotor shaft, wherein said extension boom includes a driveshaft and a second belt-and-pulley drive train;

a polygonal shaft being attached to the second belt-and-pulley drive train, wherein said polygonal shaft includes a right length and a left length that are comparable, and wherein each said right length and said left length extends outward from the extension boom;

a set of tilling elements being symmetrically mounted on the right length and the left length of the polygonal shaft, wherein said set of tilling elements is comprised of a plurality of paired staggered tine disks and round brushes, wherein each of the paired staggered tine disks includes a first disk with an outward facing plurality of tines radiating from a first plate with a first center polygonal opening, wherein the tines are relatively thick have a thickness-to-length ratio of about 0.1:1, a curve out-board, a leading edge and a peripheral edge that are hardened and tapered, and a second disk with an inward facing plurality of tines radiating from a second plate with an angularly turned second center polygonal opening aligned with the first center polygonal opening, and wherein the inward facing plurality of tines are relatively thick and have a thickness-to-length ratio of about 0.1:1, curve inward, and include an opposing leading edge and an opposing peripheral edge that are hardened and tapered;

a drive train assembly comprising a first belt-and-pulley drive train with a first smaller pitch diameter grooved pulley being mounted on a rotor shaft, a first larger pitch diameter grooved pulley on an out-board end of the driveshaft, and a first grooved belt being tensioned with a first idler roll, wherein the first belt transmits rotational power from the rotor shaft of the motor to the driveshaft, and the second belt-and-pulley drive train is located within the extension boom, wherein the second belt-and-pulley drive train includes a second smaller pitch diameter grooved pulley on an in-board end of the driveshaft, a second larger pitch diameter grooved pulley on the polygonal shaft, and a second belt tensioned with a second idler roll, wherein the second belt-and-pulley transmits rotational power from the second smaller pitch diameter grooved pulley to the second larger pitch diameter grooved pulley therein to rotate the polygonal shaft, and wherein cumulatively the first belt-and-pulley drive train and the second belt-and-pulley drive train increase torque and decrease rpm of the polygonal shaft; and a rearward mount for attaching the excavator tool to an interface element, wherein the interface element provides a connecting assembly for the tool to be fastened to one of a robotic platform and an auxiliary element associated with the robotic platform.

* * * * *